US010870144B2

(12) United States Patent
Maritz et al.

(10) Patent No.: US 10,870,144 B2
(45) Date of Patent: Dec. 22, 2020

(54) RING ROLLING DEVICE WITH AXIALLY FIXED ROLLING BEARINGS

(71) Applicant: Hatebur Umformmaschinen AG, Reinach (CH)

(72) Inventors: Andreas Maritz, Dornach (CH); Andreas Matt, Murg (DE); Thomas Christoffel, Wittnau (CH)

(73) Assignee: Hatebur Umformmaschinen AG, Reinach (CH)

( * ) Notice: Subject to any disclaimer, the term of this patent is extended or adjusted under 35 U.S.C. 154(b) by 316 days.

(21) Appl. No.: 15/566,746

(22) PCT Filed: Apr. 13, 2016

(86) PCT No.: PCT/EP2016/058075
§ 371 (c)(1),
(2) Date: Oct. 16, 2017

(87) PCT Pub. No.: WO2016/166133
PCT Pub. Date: Oct. 20, 2016

(65) Prior Publication Data

US 2018/0117663 A1 May 3, 2018

(30) Foreign Application Priority Data

Apr. 17, 2015 (CH) ..... 0534/15

(51) Int. Cl.
*B21H 1/12* (2006.01)
*B21H 1/06* (2006.01)

(52) U.S. Cl.
CPC ..... *B21H 1/12* (2013.01); *B21H 1/06* (2013.01)

(58) Field of Classification Search
CPC .... B21H 1/06; B21H 1/10; B21H 1/12; B21B 25/00; B21B 25/02; B21B 5/00; F16C 33/6659; F16C 33/6677; F16C 37/007
See application file for complete search history.

(56) References Cited

U.S. PATENT DOCUMENTS 3,146,612 A * 9/1964 Lorenz ..... F16D 7/02 464/30
3,729,868 A 5/1973 Burum
(Continued)

FOREIGN PATENT DOCUMENTS

CH 706844 A1 2/2014
CH 706844 A1 * 2/2014 ..... B21H 1/12
(Continued)

OTHER PUBLICATIONS

Author: Maritz, Title: Ring Rolling Apparatus, Published: Feb. 28, 2014, Translated: Aug. 27, 2019, 14 pgs (Year: 2014).*
(Continued)

*Primary Examiner* — Debra M Sullivan
*Assistant Examiner* — Matthew Kresse
(74) *Attorney, Agent, or Firm* — The Webb Law Firm

(57) ABSTRACT

A ring rolling device for enlarging a ring blank includes a press element, a rotatably mounted mandrel and an advancing arrangement in which the mandrel is rotatably mounted with a first end part in a first rolling bearing and with a second end part in a second rolling bearing. The ring blank can be mounted around the mandrel. By means of the advancing arrangement, the mandrel is movable towards the press element and away from the latter again, wherein a roll gap which decreases in size, and in which the ring blank is rolled, is formed between the mandrel and the press element. The two rolling bearings are arranged axially fixed in the
(Continued)

advancing arrangement, and the mandrel is mounted so as to be axially movable relative to these two rolling bearings.

21 Claims, 8 Drawing Sheets

(56) References Cited

U.S. PATENT DOCUMENTS

| | | | | | |
|---|---|---|---|---|---|
| 4,326,397 | A | * | 4/1982 | Strugala | B21H 1/06 72/106 |
| 5,605,068 | A | | 2/1997 | Yamasoto et al. | |

FOREIGN PATENT DOCUMENTS

| | | | | | |
|---|---|---|---|---|---|
| CN | 1739880 | A | | 3/2006 | |
| CN | 102039359 | A | | 5/2011 | |
| CN | 102319765 | A | | 1/2012 | |
| CN | 102861842 | A | | 1/2013 | |
| DE | 703436 | C | | 3/1941 | |
| DE | 2615802 | A1 | | 10/1977 | |
| DE | 102010014064 | B4 | * | 12/2012 | F16C 33/6674 |
| GB | 628012 | A | | 8/1949 | |
| JP | S4627048 | B | | 8/1971 | |
| JP | S4826238 | U | | 3/1973 | |
| JP | 5019517 | B1 | | 7/1975 | |
| JP | S5645543 | U | | 4/1981 | |
| JP | S62244541 | A | | 10/1987 | |
| JP | 11169988 | A | | 6/1999 | |
| JP | H11285762 | A | | 10/1999 | |
| JP | 2001121233 | A | | 5/2001 | |
| JP | 200655894 | A | | 3/2006 | |
| JP | 2007289967 | A | | 11/2007 | |
| KR | 20130046731 | A | * | 5/2013 | |
| WO | 2009147359 | A1 | | 12/2009 | |

OTHER PUBLICATIONS

Author: Wook, Title: Bushing Having Prevent Separation, Published: May 8, 2013, Translated: Sep. 4, 2019, 6 pgs (Year: 2013).*

Author: Bernhard et al, Title: Lubricating oil supply device, Published:Apr. 7, 2010, Translated Apr. 2, 2020, 10 pgs (Year: 2010).*

CH706844A1—Maritz—Ring Rolling Apparatus—Translated: Aug. 27, 2019 (Year: 2014).*

Hinzen, "Basiswissen Maschinenelemente", Oldenbourg Wissenschaftsverlag GmbH, 2014, p. 60-69, 2nd Edition.

Hoffmann et al., "Handbuch Umformen", Handbuch der Fertigungstechnik, 2012, p. 192-195, Carl Hanser Verlag, Munchen, Germany.

* cited by examiner

RING ROLLING DEVICE WITH AXIALLY FIXED ROLLING BEARINGS

CROSS-REFERENCE TO RELATED APPLICATIONS

This application is the United States national phase of International Application No. PCT/EP2016/058075 filed Apr. 13, 2016, and claims priority to Swiss Patent Application No. 00534/15 filed Apr. 17, 2015, the disclosures of which are hereby incorporated in their entirety by reference.

BACKGROUND OF THE INVENTION

Field of the Invention

The present invention relates to a ring rolling device.

Description of Related Art

In a known variant for producing rings, for example for ball bearings, a ring blank is first of all forged and is then further processed by ring rolling. To roll a ring, the ring blank is mounted around a mandrel and then rolled between the mandrel and a forming roller. In doing so, the thickness of the ring blank is reduced and at the same time its circumference is increased, since no material is removed. To reduce the thickness of the ring blank, the roll gap between the mandrel and the forming roller has to be reduced continuously, which can be done, for example, by a displacement of the mandrel towards the forming roller or vice versa.

DE 703 436 C discloses a ring rolling device which comprises a roller as press element and a rotary table with a plurality of mandrels mounted rotatably therein, around which mandrels are mounted the ring blanks that are to be rolled. By turning the rotary table, the mandrels are movable towards the press element and away from the latter again. A roll gap decreasing in size is thus formed between the mandrel and the press element, in which roll gap the ring blank is rolled. The mandrels each engage at the bottom in a conical bore in a mandrel roller pin mounted rotatably in the rotary table and are each firmly connected at the top to a second mandrel roller pin.

Disadvantages of this ring rolling device are the relatively imprecise mounting of the mandrels, which leads to rolling inaccuracies, and the large and relatively heavy rotary table, which slows down the operation.

A further ring rolling device for enlarging a ring blank is described in CH 706 844 A1. It comprises a press element, a plurality of rotatably mounted mandrels, around each of which a ring blank can be mounted, and a rotatable revolver drum, in which the mandrels are rotatably mounted. By rotation of the revolver drum, the mandrels are movable towards the press element and away from the latter again. The revolver drum is arranged relative to the press element such that, by rotation of the revolver drum, a roll gap of decreasing size is formed between the respective mandrel and the press element, in which roll gap the ring blank is rolled during the rotation of the revolver drum. For the rotatable mounting of the mandrels, the revolver drum has, for each mandrel, for example two rolling bearings and at least two rotatably mounted support rollers, which support the mandrel in the direction of the rotation axis of the revolver drum, such that, during the rolling procedure, the mandrel is located between the support rollers and the press element. The at least two rotatably mounted support rollers permit a supporting of the mandrel during the rolling procedure, in order to take up the rolling forces along a desired mandrel length, and a rotation of the mandrel about its rotation axis during the rolling procedure, wherein the mandrel rolls on its support rollers.

The ring rolling device according to CH 706 844 A1 has the advantage that both the delivery of the ring blank to the rolling position and the rolling of the ring blank are effected by the rotation of the revolver drum with respect to the press element. By means of this rotation, a roll gap is initially formed and the ring blank is brought into contact with the press element, and the roll gap is then reduced in size, as a result of which the ring blank is rolled between the mandrel and the press element, that is to say the wall thickness of the ring blank is reduced. The at least two rotatably mounted support rollers permit a supporting of the mandrel during the rolling procedure, in order to take up the rolling forces along a desired mandrel length, and a rotation of the mandrel about its rotation axis during the rolling procedure. Good rolling precision can be achieved in this way. However, a disadvantage of this known ring rolling device lies in the complexity of the device, which is a result of the many support rollers and their mounting, which complexity also has a negative impact on the stiffness of the installation, and in the relatively large masses that likewise have to be moved, inter alia, on account of the support rollers.

Therefore, the object of the present invention is to simplify the structure of a ring rolling device of the type in question. The achievable rolling precision is to be improved as much as possible, the masses that are moved are to be kept as low as possible, and the stiffness is to be increased as far as possible.

This object is achieved by the ring rolling device according to the invention.

A ring rolling device for enlarging a ring blank comprises a press element, a rotatably mounted mandrel, which has a first end part, a second end part and a middle part between these, around which the ring blank can be mounted, and an advancing arrangement in which the mandrel is rotatably mounted with its first end part in a first rolling bearing and with its second end part in a second rolling bearing, such that the middle part of the mandrel lies free for the mounting of the ring blank. By means of the advancing arrangement, the mandrel is movable towards the press element and away from the latter again, wherein a roll gap which decreases in size, and in which the ring blank is rolled, is formed between the mandrel and the press element. The second rolling bearing is arranged axially fixed in the advancing arrangement, and the mandrel is mounted so as to be axially movable relative to the second rolling bearing, such that the second end part of the mandrel can be pulled out of the second rolling bearing or pushed into the latter. According to the invention, the first rolling bearing is also arranged axially fixed in the advancing arrangement, and the mandrel is mounted so as to be axially movable relative to the first rolling bearing.

The rotary mounting of the mandrel in axially fixed bearings is less structurally complicated than the mounting using other types of bearings and, in addition, support rollers. Moreover, less mass has to be moved both during the movement of the advancing arrangement and when the mandrel is pushed through the ring blank and inserted into the second rolling bearing or, conversely, when the mandrel is removed again from the rolling bearing. The latter is the case since the rolling bearings themselves are axially fixed and it is only the mandrel itself that has to be moved axially, that is to say in its longitudinal direction. This permits a high speed of feeding and rolling of ring blanks in the machine cycle.

Preferably, the first and second rolling bearings are designed as tangentially movable bearings, in particular as spherical roller bearings or self-aligning ball bearings. Spherical roller bearings and self-aligning ball bearings withstand high radial loads and also axial loads and are very suitable for compensation of errors of alignment. Moreover, they are relatively compact.

Advantageously, axially fixed sleeve-shaped bushings for receiving the mandrel are mounted rotatably in the first and second rolling bearings. The bushings permit simple insertion of the mandrel into the rolling bearings.

Preferably, the bushings are arranged so as to be tiltable relative to the rotation axis of the first and second rolling bearings, wherein the tiltability of the bushings is expediently limited by stops. This permits safe insertion of the mandrel into the rolling bearings or their bushings.

To make it easier to insert the mandrel into the second rolling bearing, the bushing arranged in the second rolling bearing advantageously has a funnel-shaped insertion bevel. For the same reason, the mandrel at its front end on the second end part advantageously has a conical or rounded shape.

To increase the rolling precision, the advancing arrangement, in an advantageous design variant, has a preferably adjustable stop element for the front end of the mandrel, for positioning the mandrel in the longitudinal direction thereof. This permits an exact positioning of the mandrel, and of the ring blank arranged thereon, for the rolling procedure and is particularly of significance when the mandrel and/or the press element has a profile that is to be transferred to the ring blank.

Expediently, the stop element protrudes partially into the second rolling bearing and is designed with a feed line, for a cleaning agent and/or coolant, emptying into the interior of the second rolling bearing. In this way, at times when there is no mandrel mounted in the bushings or when the mandrel has been at least partially pulled out, the bushings can be easily cleaned and/or cooled.

Advantageously, the stop element is mounted rotatably. In this way, it is possible to considerably reduce the wear caused by a rotating mandrel bearing thereon.

In an alternative design variant, the advancing arrangement expediently comprises an alternative stop element for a stop collar on the first end part of the mandrel, for positioning the mandrel in the longitudinal direction thereof. Preferably, the alternative stop element is formed by the bushing mounted rotatably in the first rolling bearing. This design of the stop element is particularly simple in terms of construction.

According to a preferred embodiment, the advancing arrangement is a rotatable revolver drum, wherein the revolver drum is arranged relative to the press element such that, by rotating the revolver drum, a decreasing roll gap is formed between the mandrel and the press element. The mounting of the mandrel on a revolver drum is structurally expedient and permits a high machine cycle.

Preferably, the revolver drum comprises two disc-like drum parts which are spaced apart from each other and are rigidly connected to each other for conjoint rotation and in which the first rolling bearing and the second rolling bearing for the mandrel are arranged in an axially fixed manner. By means of the two disc-like drum parts rigidly connected to each other for conjoint rotation, the mandrel can be mounted in a stable and at the same time rotatable manner on both sides of the middle part bearing the ring blank.

Advantageously, the first and second rolling bearings are each mounted in the drum parts so as to be exchangeable in their entirety. In this way, the ring rolling device can be adapted quickly and easily to another mandrel diameter.

Advantageously, at least the bushing arranged in the second rolling bearing has a form-fit element, preferably designed as an annular groove, for the engagement of an assembly tool. In this way, the second rolling bearing can be easily removed from the ring rolling device by means of the tool.

Advantageously, the ring rolling device has a preferably closed cooling system for the rolling bearings and/or advancing arrangement.

Advantageously, the ring rolling device according to the invention has a mandrel adjuster for adjusting the mandrel in the longitudinal direction of the mandrel. By pulling back the mandrel, delivering a ring blank to a loading position and pushing the mandrel forwards again and pushing the mandrel through the ring blank located in the loading position, it is possible to arrange or mount this ring blank easily around the mandrel. Conversely, with the same or a further mandrel adjuster, the finished rolled ring can be removed from the mandrel by pulling the mandrel back.

Preferably, the ring rolling device according to the invention has a feeding mechanism for ring blanks, with which mechanism ring blanks can be delivered individually to a location at which the mandrel can be pushed through the delivered ring blank, that is to say the abovementioned loading position. Together with the mandrel adjuster, this allows a ring blank to be easily mounted or arranged around the mandrel.

Advantageously, several mandrels are mounted rotatably in the advancing arrangement. In this way, different procedures can take place simultaneously at different stations. For example, a ring blank can be mounted around a mandrel at a first station, a ring blank can be rolled at a second station, and a ring blank can be removed from a mandrel at a third station. The rolling throughput can thus be considerably increased, that is to say more ring blanks can be rolled into rings in a shorter time.

On account of the higher throughput, ring rolling can take place in line with the production of ring blanks, and the ring rolling device can, for example, be annexed to a cold-forming or hot-forming machine. By annexation to a hot-forming machine, it is possible to exploit the advantage that the still hot ring blanks produced by the hot-forming machine can be rolled directly with the ring rolling device. Additional heating of the ring blanks for hot ring rolling can thus be dispensed with. In principle, however, preliminary heating of the ring blanks is possible before the ring rolling, and ring rolling devices according to the invention can be used both for hot ring rolling and for cold ring rolling.

In hot ring rolling, the components of the rolling device, e.g. mandrel, press element, drive roller, etc., may optionally be cooled.

Preferably, the ring rolling device according to the invention has a drive mechanism for driving the press element such that, during the rolling procedure, the ring blank is rotatable by the movement of the press element. This makes it possible to rotate the ring blank several times on the rotatably mounted mandrel with the aid of the press element during the rolling procedure, wherein the ring blank is rolled to a lesser thickness upon each rotation. In this way, it is possible to achieve a greater reduction of thickness, and a more uniform rolling that is gentler on material.

Advantageously, the press element is a rotatably mounted drive roller. Such a drive roller can be driven continuously, for example, by means of a motor and can transmit its rotational movement to the ring blank mounted around the mandrel as soon as the latter comes into contact with the drive roller. Compared to a linear press element, which would also be conceivable in the ring rolling device according to the invention, the rotation of the drive roller can take place continuously and at a constant speed, and the press element does not have to be reset after the rolling procedure.

BRIEF DESCRIPTION OF THE DRAWINGS

The ring rolling device according to the invention is described in more detail below on the basis of illustrative embodiments and with reference to the attached drawings, in which.

DESCRIPTION OF THE INVENTION

Figure 1:
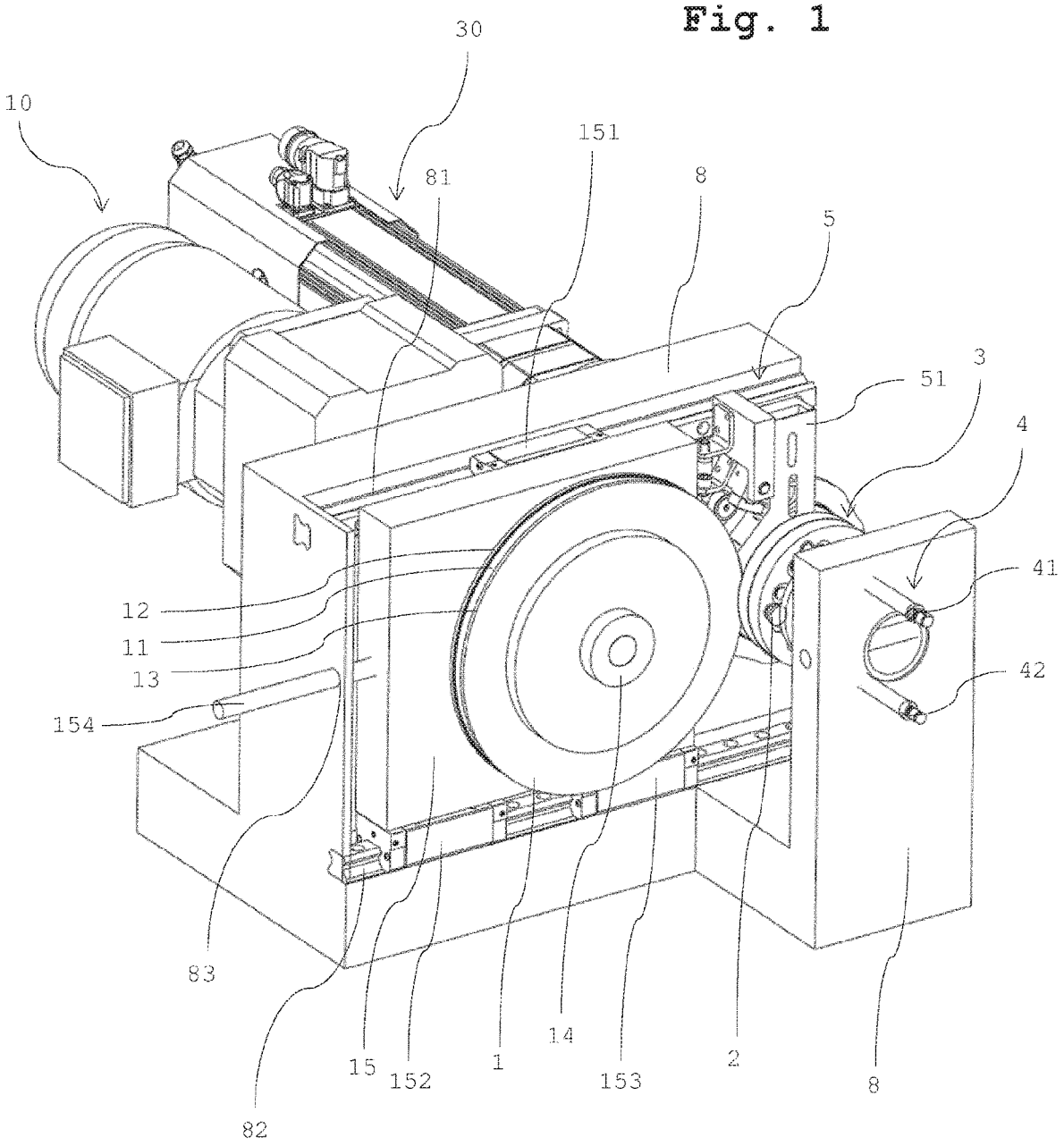
FIG. 1 shows a perspective view of an illustrative embodiment of a ring rolling device according to the invention.

The following applies to the description below: If, in order to avoid ambiguity in the drawing, a figure contains reference signs which are not mentioned in the directly associated part of the description, then reference is made to the point where these are explained in previous or following parts of the description. Conversely, in order to avoid over-complicating the drawing, reference signs that are less relevant to a direct understanding are not included in all of the figures. To this end, reference is made in each case to the other figures.

Figure 2:
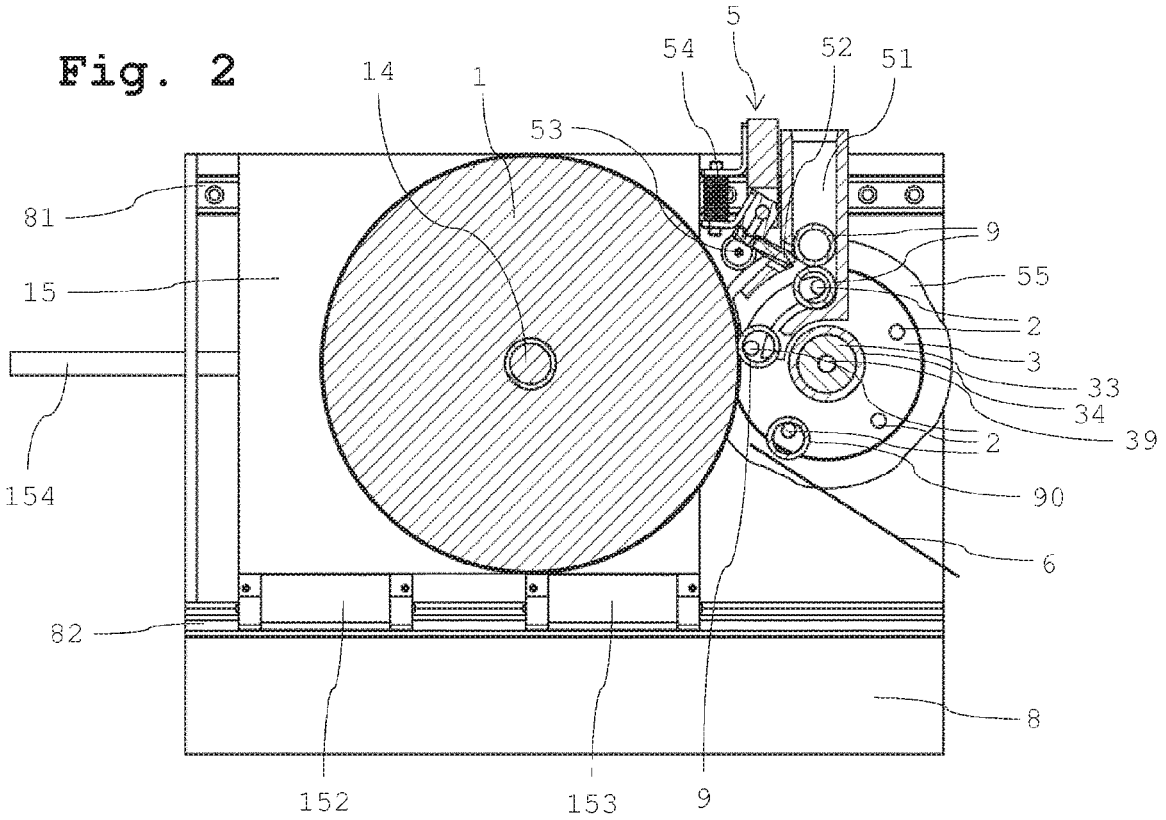
FIG. 2 shows a section through the ring rolling device from FIG. 1, shortly before a ring blank is rolled.

The illustrative embodiment of a ring rolling device according to the invention shown in FIGS. 1 and 2 comprises, as press element, a drive roller 1 which, on its circumference, has a roll surface 11, which is limited on both sides by a collar 12, 13. The collars 12, 13 prevent a lateral expansion of the ring blank 9 during the ring rolling. The drive roller 1 is rotatably mounted on a bearing plate 15 via a shaft 14 and is driven by means of a drive mechanism 10.

By way of three rail grip elements 151, 152 and 153, for example, the bearing plate 15 is mounted at an upper part and at a lower part on rails 81 and 82, respectively, in such a way as to be movable in the direction of an axis of rotation 39 (FIG. 2) of the revolver drum, which rails 81, 82 for their part are firmly anchored in a machine frame 8. By means of an adjustment spindle 154, the bearing plate 15 and therefore the drive roller 1 mounted thereon can be adjusted in the direction of the roll gap, whereby the size of the roll gap at its narrowest point can be adjusted. For this purpose, the adjustment spindle 154 has, for example, an outer thread which engages in an inner thread in a passage 83 through the machine frame 8, through which passage the adjustment spindle 154 is arranged.

In ring rolling, the ring blank 9 is rolled between the drive roller 1 and a mandrel 2, which is mounted rotatably in an advancing arrangement in the form of a revolver drum 3. It will be seen from FIG. 2 that, in the present revolver drum 3, five mandrels 2 are mounted rotatably and uniformly distributed with respect to the rotation axis 39 of the revolver drum at an angular interval of 72°. The revolver drum 3 is mounted rotatably on the machine frame 8 via a shaft 33 and is rotated by means of a drive mechanism 30, for example an electrical drive or servo motor.

To feed ring blanks 9 to the mandrels 2 in the revolver drum 3, the ring rolling device shown has a ring blank feed mechanism 5. The ring blank feed mechanism 5 is designed to feed ring blanks 9 individually to a location at which a mandrel 2 can be pushed through the fed ring blank 9, that is to say a loading position. The ring blank feed mechanism 5 has a storage well 51 in which several ring blanks 9 can be stored. At its lower end, the storage well 51 is provided with an opening through which a ring blank 9 passes directly to the loading position by gravity. To prevent ring blanks 9 from falling in an uncontrolled manner in the direction of the loading position, an articulated retention element 52 is present which, by means of a spring element 54 acting on a cam roller 53, is held in a retention position in which it holds the ring blanks 9 in the storage well 51. To release an individual ring blank 9, a control cam 55 arranged rotatably about the rotation axis 39 of the revolver drum easily acts on the cam roller 53 counter to the spring force.

To be able to mount a ring blank 9 around a mandrel 2 and later remove a rolled ring 90 again from the mandrel 2, the ring rolling device has a mandrel adjuster 4 for adjusting the mandrel 2 in the longitudinal direction of the mandrel 2. Since the mounting of the ring blank 9 around the mandrel 2 and the removal from the mandrel 2 of the ring 90 rolled from the blank 9 take place at two different locations, namely on the one hand directly below the storage well 51 and on the other hand after a rotation of the revolver drum 3 through approximately 150°, the mandrel adjuster 4 comprises two separate adjusting cylinders 41 and 42, which are secured on the machine frame 8.

To carry off the rolled ring 90 after the removal from the mandrel 2, an outlet channel 6 is arranged underneath the site of the ring removal in the ring rolling device shown.

Figure 3:
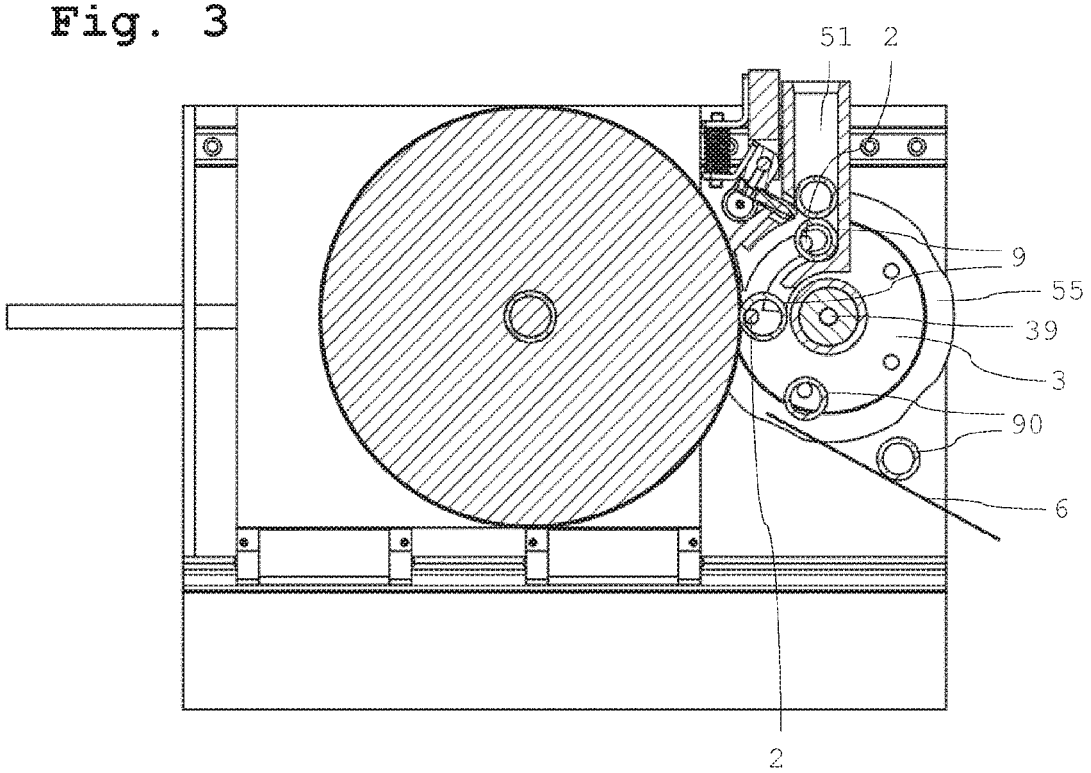
FIG. 3 shows a section through the ring rolling device from FIG. 1 analogously to FIG. 2, but during the rolling of a ring blank.

FIG. 3 corresponds substantially to FIG. 2, the only difference being that the revolver drum 3 in FIG. 3 has been turned about 10° further anticlockwise than in FIG. 2.

In FIG. 2, a first ring blank 9 is located in the loading position directly underneath the storage well 51, and a first mandrel 2 is being pushed through this first ring blank 9. A second ring blank 9, mounted around a second mandrel 2 located at an angular distance of 72° from the first mandrel 2, is positioned shortly before contact with the drive roller 1, i.e. has not yet been rolled.

To arrive at the situation shown in FIG. 3, the revolver drum 3 is turned approximately 10° anticlockwise. The first ring blank 9 remains for the time being in the loading position directly underneath the storage well 51, but it can be seen that the first mandrel 2 has rotated through approximately 10° and now bears on the left-hand inner face of the first ring blank 9 such that, upon further rotation, it will carry the latter with it.

By means of the rotation of the revolver drum 3, the second ring blank 9, on account of the reduction in size of the roll gap between the second mandrel 2 and the drive roller 1, has come into contact with the latter and has been rolled to a lesser thickness. By means of the contact with the drive roller 1, which preferably turns at a constant speed and is driven by the drive mechanism 10, a torque is transmitted to the ring blank 9, such that the latter, together with the rotatably mounted second mandrel 2, is caused to rotate about the rotation axis of the mandrel, that is to say its central axis. Depending on the size of the ring blank and on the desired reduction of the wall thickness, it has proven particularly advantageous for the ring blank to be rotated three to thirty times, in particular eight to twelve times, preferably about ten times, during the rolling procedure. The rotational speeds of the drive roller 1 and of the revolver drum 3 are suitably chosen in order to achieve this. The multiple rotation of the ring blank 9 during the ring rolling procedure permits a greater reduction of thickness and a more uniform rolling, which is gentler on the material.

Figure 4:
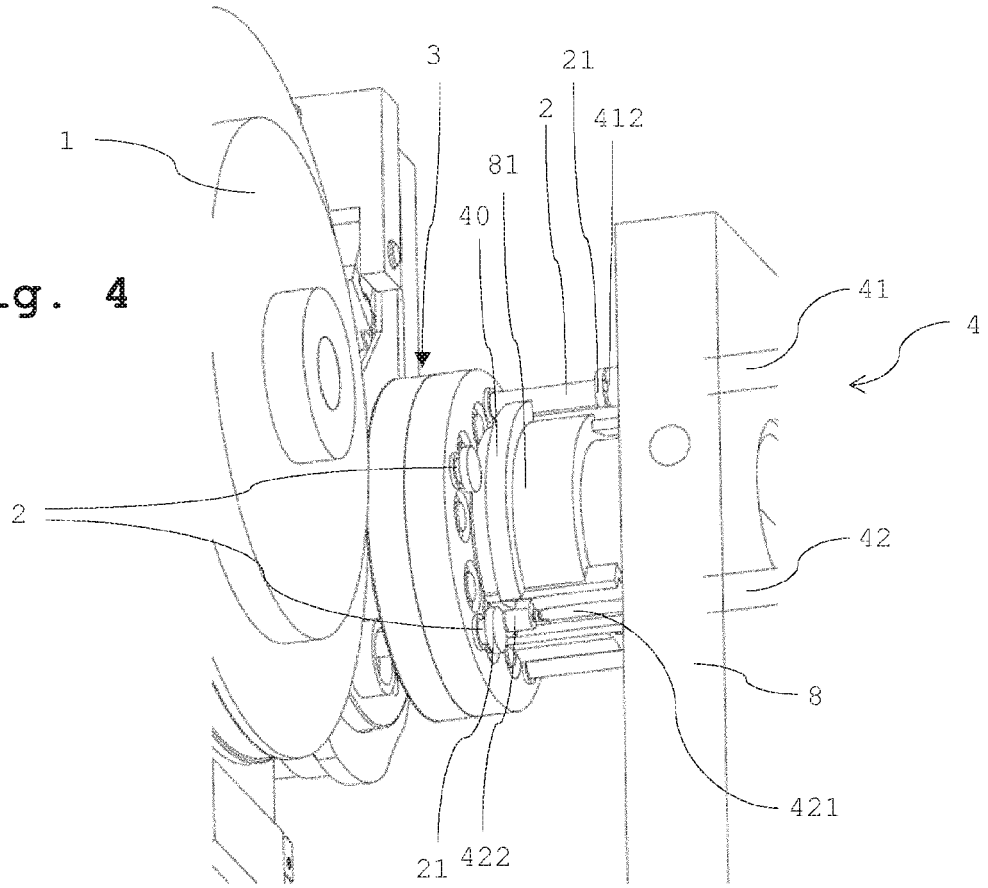
FIGS. 4-5 show different perspective details of parts of the ring rolling device from FIG. 1.
Figure 5:
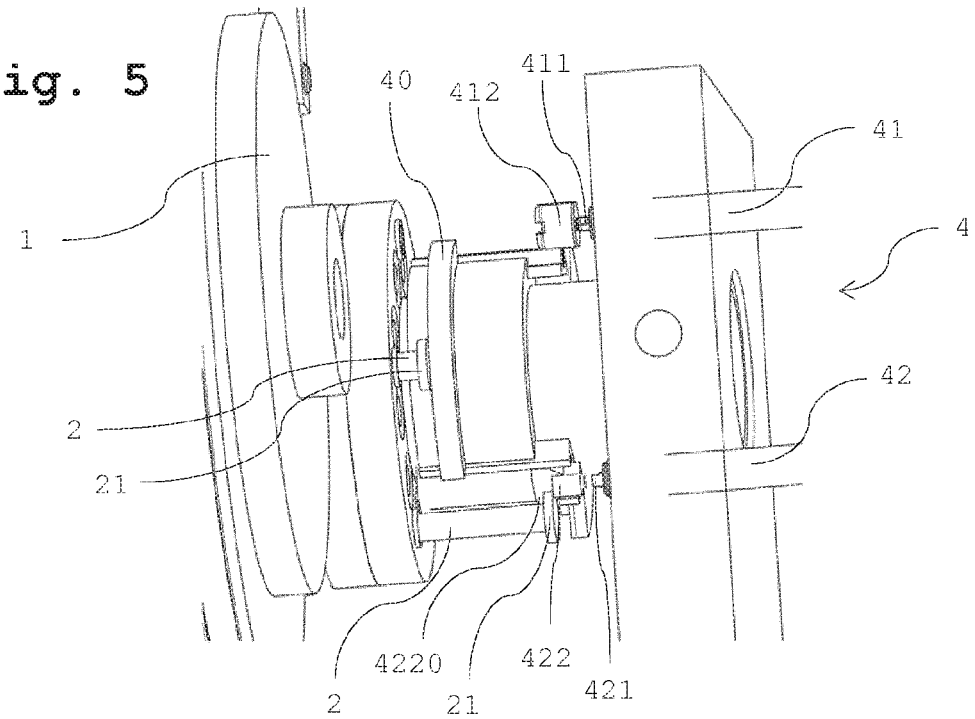

The mandrel adjuster 4 is shown in greater detail in FIGS. 4 and 5. As has already been described above, the mandrel adjuster comprises two separate adjusting cylinders 41 and 42, which are secured on the machine frame 8. The adjusting cylinder 41 comprises an extendible piston 411, on which a thrust head 412 is secured. In the situation shown in FIG. 4, the thrust head 412 pushes against a head 21 of the mandrel 2 and, upon extension of the piston 411, thus pushes the mandrel 2 in the longitudinal direction of the mandrel into the revolver drum 3, where the mandrel 2 is pushed through a ring blank 9 located in the loading position.

The adjusting cylinder 42 comprises an extensible piston 421 on which a gripper head 422 is secured. In the situations shown in FIGS. 4 and 5, the gripper head 422 engages behind the mandrel head 21 of a further mandrel 2 and, upon retraction of the piston 411, thus pulls this mandrel 2 in the longitudinal direction of the mandrel out of the revolver drum 3 and therefore also out of the ring 90 that has been rolled to completion in this position of the revolver drum. In FIG. 4, the mandrel 2 is still located in the starting position in the revolver drum 3, whereas in FIG. 5 it has been driven partially out of the revolver drum 3. The engagement of the gripper head 422 behind the mandrel head 21 is effected by the rotation of the revolver drum 3, as a result of which the mandrel head 21 is pushed over a gripper part 4220 of the gripper head 422.

To ensure that the mandrel 2 is not inadvertently moved out of the revolver drum 3 again during the rotation of the revolver drum 3 in the anticlockwise direction, the ring rolling device has a hold-down means 40, which is secured like a flange about a mounting pipe 81 secured on the machine frame 8. This hold-down means 40 forms a stop for the mandrel head 21, as can best be seen in FIG. 5.

Figure 6:
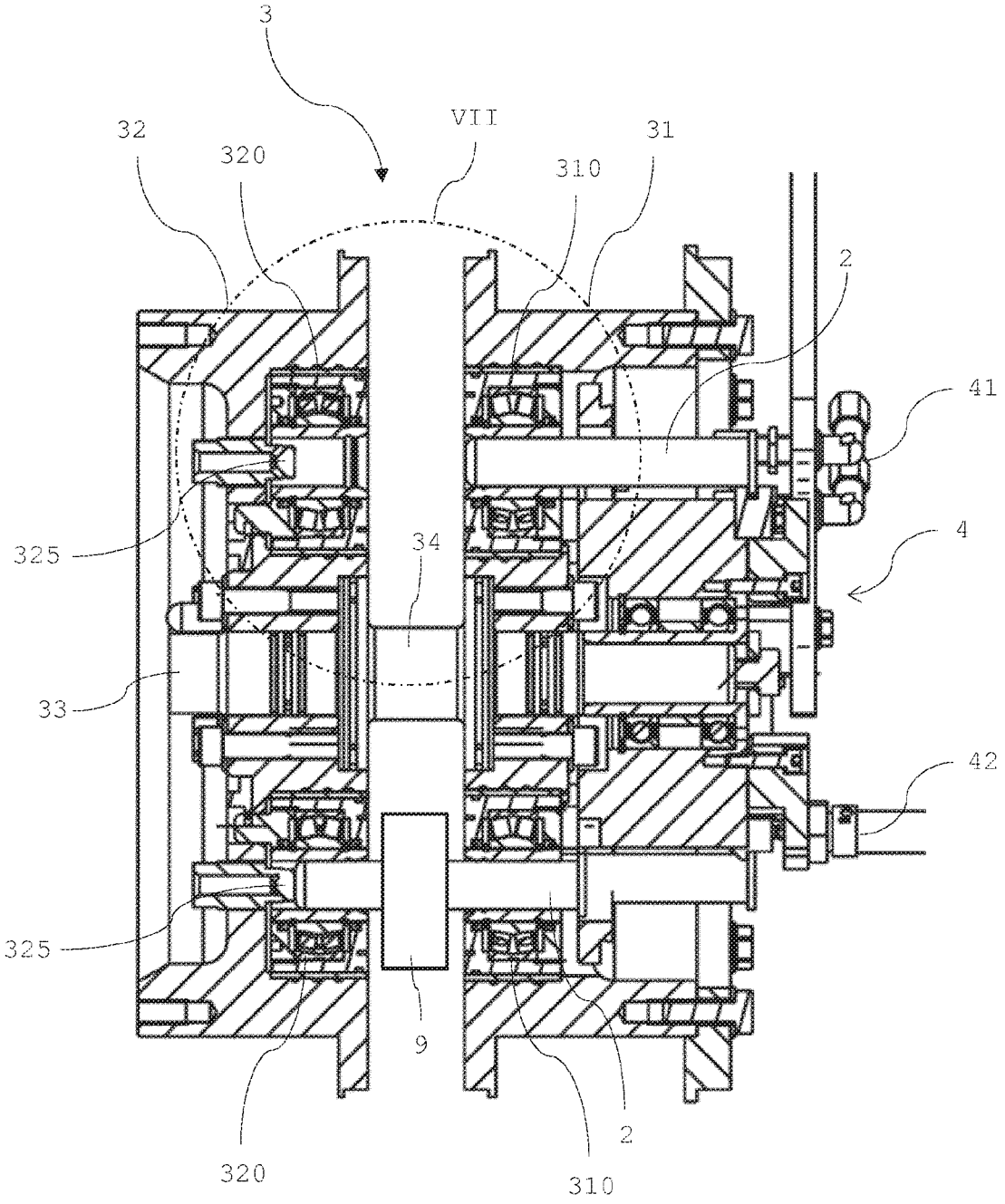
FIG. 6 shows a sectional view of a revolver drum of the ring rolling device from FIG. 1.

It will be seen from FIG. 6 that the revolver drum 3, in the illustrative embodiment shown, comprises two disc-like drum parts 31 and 32 which are spaced apart from each other and are rigidly connected to each other for conjoint rotation via the common shaft 33 (see FIG. 2), in each of which drum parts a respective end part of the mandrels 2 is rotatably mounted such that in each case a middle part of the mandrels 2, around which a ring blank 9 is mounted, lies free between the two disc-like drum parts 31, 32. A spacer 34 (FIG. 2) is arranged between the two disc-like drum parts 31, 32 and fixes the distance between the drum parts 31 and 32.

The main difference between the ring rolling device according to the invention and the ring rolling device according to CH 706 844 A1 is the way in which the mandrels 2 are mounted rotatably in the revolver drum 3. In the known ring rolling device, the mandrels are mounted, inter alia, on rotatable support rollers. By contrast, the mandrels 2 in the ring rolling device according to the invention are each mounted in two rolling bearings which are arranged in an axially fixed manner in the revolver drum 3, as is shown in FIG. 6 and in particular in the enlarged detail in FIG. 7.

Figure 7:
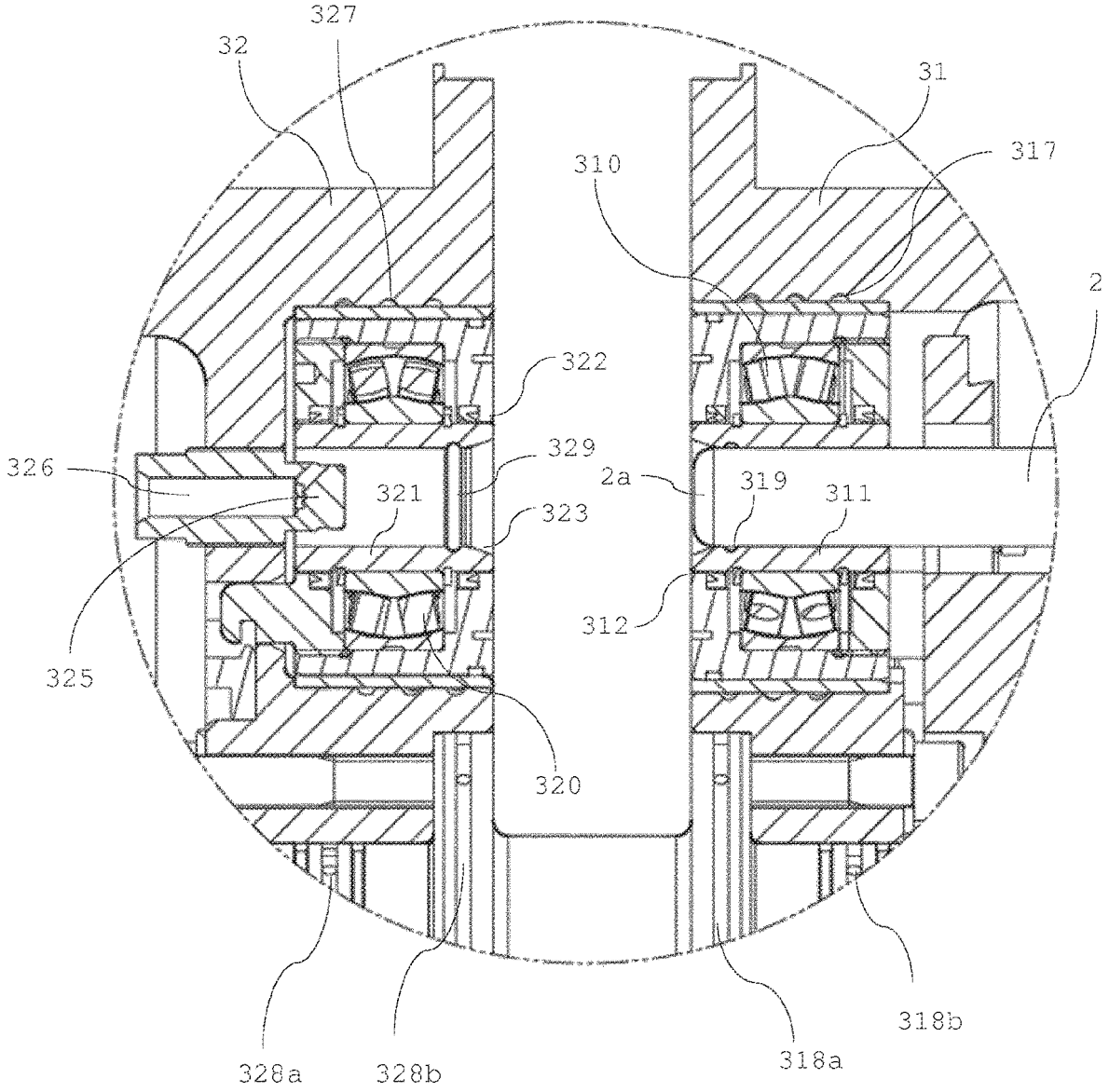
FIG. 7 shows an enlarged view of the detail VII from FIG. 6.

Five first rolling bearings 310 and five second rolling bearings 320 are arranged in an axially fixed manner in the two disc-like drum parts 31 and 32 and are distributed uniformly about the circumference, with a first rolling bearing 310 and a second rolling bearing 320 in each case lying in axial alignment opposite each other. Sleeve-shaped bushings 311 and 321 are mounted rotatably in the rolling bearings 310 and 320, respectively, and are secured against axial movement (FIG. 7). In each case, one bushing 311 and one bushing 321 together receive a mandrel 2. With the mandrel 2 driven into the revolver drum 3 (lower part of FIG. 6), a first end part of the mandrel 2 is located in the bushing 311 of the first rolling bearing 310 and a second end part of the mandrel 2 is located in the bushing 321 of the second rolling bearing 320. Located between the two end parts is the middle part of the mandrel 2, on which part the blank 9 to be rolled bears. With the mandrel 2 pulled partially out of the revolver drum 3, in accordance with the upper part of FIG. 6, the front second end part of the mandrel 2 (the end part on the left in the drawing), which was previously received in the bushing 321 of the second rolling bearing 320, is now located in the bushing 311 of the first rolling bearing 310. During the inward and outward movement of the mandrels 2, the rolling bearings 310 and 320, and the bushings 311 and 321 mounted rotatably therein, remain axially fixed in position, i.e. only the mandrels themselves are moved. This has the advantage of a smaller mass being displaced, which permits quicker and easier displacement.

As is shown here, the first and second rolling bearings 310 and 320 are preferably designed as spherical roller bearings, for example as per DIN 635-2. Spherical roller bearings withstand high radial loads and also axial loads and are very suitable for compensating errors of alignment. Moreover, they are comparatively compact. On account of the inherent properties of spherical roller bearings, the bushings 311 and 321 mounted rotatably in the spherical roller bearings 310 and 320 are to a certain extent tiltable in relation to the rotation axis of the bearings, which is what permits the compensation of errors of alignment. The tiltability of the bushings 311 and 321 is limited by radial stops 312 and 322, such that the mandrels can be pushed without interference into the second rolling bearings without the rotation movement being impeded at maximum deflection.

In addition to spherical roller bearings, there are also other bearings which are tangentially free to a certain extent (e.g. CARB or toroidal roller bearings, self-aligning ball bearings or combined bearings). The tangential freedom of the bearings is crucial. Tangential freedom is to be understood as meaning that they are able to compensate for errors of alignment between the rotation axis of the bearings and the rotation axis of the mounted mandrel. Spherical roller bearings are preferred on account of their long useful life.

To make it easier to insert the mandrels 2 into the bushings 321 of the second rolling bearings 320, a funnel-shaped insertion bevel 323 is formed on the bushings 321. Moreover, at their front ends 2*a*, the mandrels 2 have a conical or rounded shape. In this way, the rolling bearings can be easily and quickly oriented with respect to each other, without the mandrel being jammed in the bushing.

In order to position the mandrels 2 in their longitudinal direction, an (e.g. by means of a screw thread) axially adjustable stop element 325 is in each case provided in the drum part 32 of the revolver drum 3, coaxially with respect to the second rolling bearings 320, which stop element 325 extends slightly into the second rolling bearings 320 or the bushings 321. By virtue of the stop element being adjustable, the demands on machining accuracy are lowered, and resetting or replacement are possible in the event of wear. The stop element 325 has a feed line 326 which, by way of smaller branch lines (not shown), opens into the interior of the bushing 321. At times when there is no mandrel 2 located in the bushing 321, a cleaning agent and/or a coolant can be fed through this feed line to said bushing 321.

Figure 8:
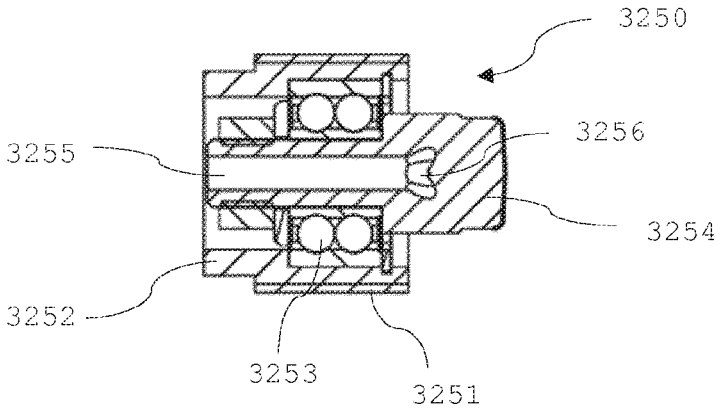
FIG. 8 shows an axial section through a stop arrangement of the ring rolling device according to a second illustrative embodiment.
Figure 9:
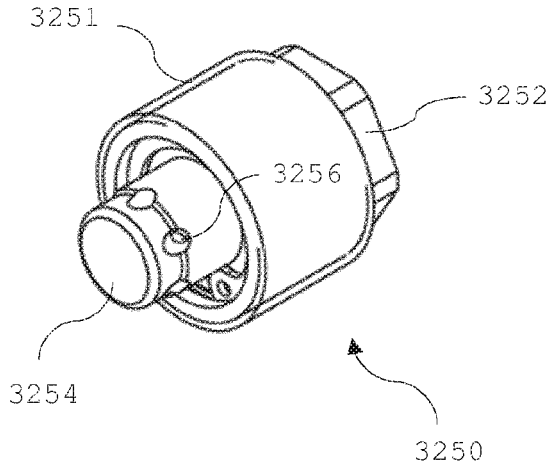
FIGS. 9-10 show two perspective views of the stop arrangement from FIG. 8.
Figure 10:
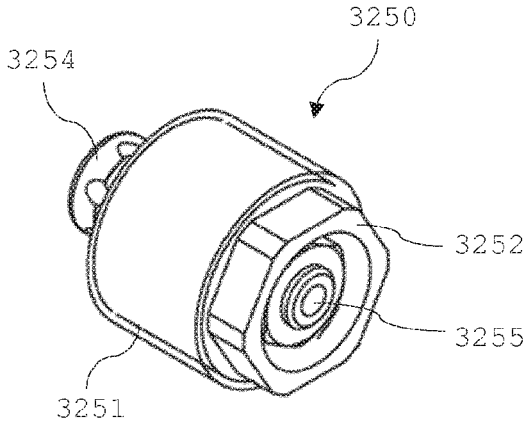

Instead of the rotationally fixed stop element 325, a stop arrangement with a rotatably mounted stop element can also be provided, as is shown in FIGS. 8-10. The stop arrangement 3250 comprises a stationary part 3252, which is provided externally with a thread 3251 and in which a stop element 3254 is rotatably mounted by means of a ball bearing 3253. The stop element 3254 has a feed line 3255 which, by way of smaller branch lines 3256, opens into the interior of the bushing 321. At times when there is no mandrel 2 located in the bushing 321, a cleaning agent and/or a coolant can be fed through this feed line to said bushing 321. Like the stop element 325, the stop arrangement 3250 is screwed into the drum part 32 of the revolver drum 3 and can be axially adjusted via the thread 3251.

Figure 11:
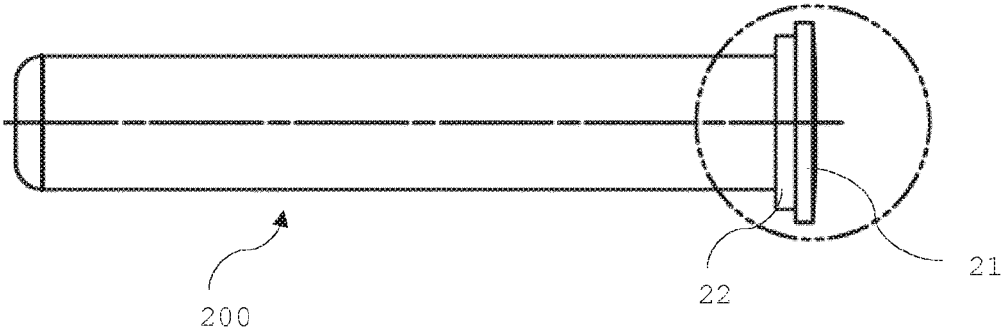
FIG. 11 shows an alternative mandrel of the ring rolling device.

As an alternative to the lengthwise positioning of the mandrel 2 via its front end 2*a*, the lengthwise positioning can also be effected by means of an alternative stop element which cooperates with a collar 22 formed on the rear end of the mandrel directly on the mandrel head 21. FIG. 11 shows a mandrel 200 equipped with such a collar 22.

Figure 12:
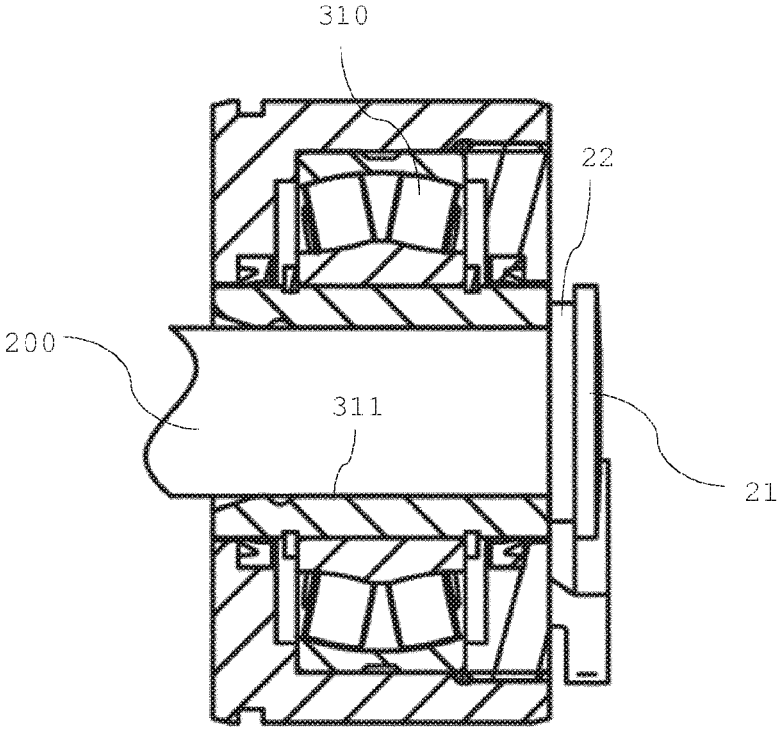
FIG. 12 shows a detail of the ring rolling device with a mandrel according to FIG. 11 located in a stop position.

As will be seen from FIG. 12, the alternative stop element is here formed by the bushing 311, which is mounted rotatably in the first rolling bearing 310 and on the front face of which the collar 22 bears when the mandrel 200 is inserted. The alternative stop element can thus rotate along with the mandrel, such that friction between the mandrel and the stop element is avoided. The collar 22 is slightly smaller in diameter than the mandrel head 21, such that the latter can still be safely gripped from behind by the gripper head 422.

The front face of the mandrel head 21 is slightly convex, such that a smaller frictional moment acts on the mandrel if the latter is pressed in the direction of the head. Alternatively, the front face could also have a conical shape or a flat shape, for example.

The rolling bearings 310 and 320 are designed as inserts which in their entirety can easily be installed in and removed from the revolver drum 3. In this way, the ring rolling device can be easily and quickly adapted to another mandrel diameter. These inserts also permit the cooling of the bearings and of the two revolver drum parts in a closed circuit.

It will be seen from FIG. 7 that the rolling bearings 310 and 320 are surrounded helically by coolant channels 317 and 327, respectively, which communicate with annular grooves 318*a*, 318*b* and 328*a*, 328*b*, respectively, via which coolant can be supplied and removed again. Together with coolant delivery lines and coolant removal lines (not shown), the helical coolant channels 317 and 327 and the annular grooves 318*a*, 318*b* and 328*a*, 328*b* form a closed coolant system for cooling the rolling bearings 310 and 320 and the two revolver drum parts 31 and 32. Seals (not shown in detail) in the inserts prevent entry of dirt and water both during the rolling operation and during periods when the device is not in use.

The first rolling bearings 310 (in each case shown on the right in the drawings) are accessible from the front face (likewise shown on the right) of the ring rolling device and can therefore be installed and removed relatively easily. By contrast, in the case of the second rolling bearings 320 shown on the left, this is more complicated if the revolver drum 3 is not intended to be disassembled. To be able also to easily disassemble and reinsert the second rolling bearings 320, their bushings 321 are equipped with a form-fit element, which permits the engagement of a special assembly tool equipped with grip elements. In the illustrative embodiment shown in FIG. 7, the form-fit element is designed as an inner peripheral annular groove 329. The bushings 311 of the first rolling bearings 310 likewise have an annular groove 319, which can likewise be used to engage a tool.

Figure 13:
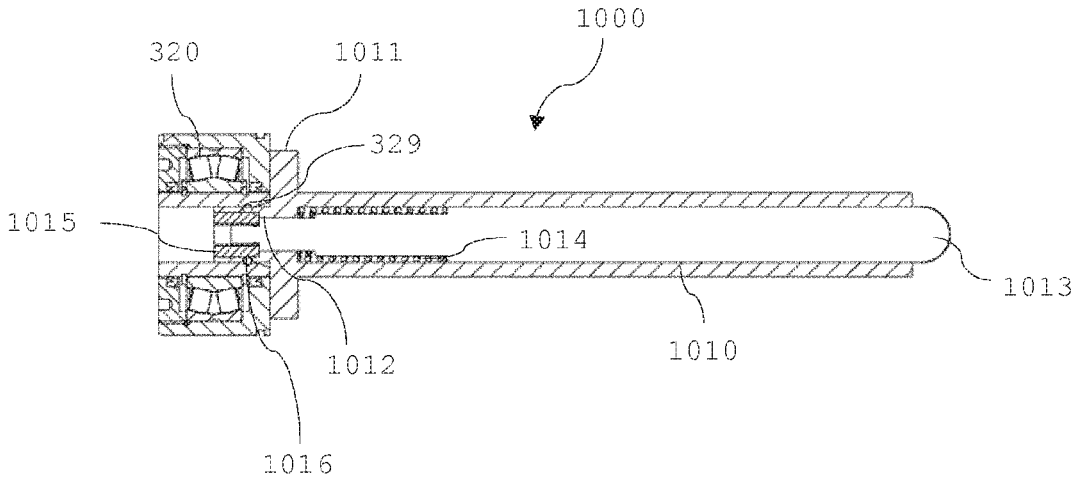
FIG. 13 shows a section through an assembly tool or disassembly tool inserted in a rolling bearing of the ring rolling device.

An example of an assembly tool 1000 is shown in FIG. 13. It comprises a tubular handle 1010 with a flange 1011 and with a tubular extension 1012, of which the external diameter corresponds to the internal diameter of the bushings 321. In the handle 1010, a ram 1013 is arranged to be movable inwards (towards the left in the figure) counter to the force of a helical spring 1014. At the front (inner) end of the ram 1013 sits a blocking slide 1015, of which the external diameter is slightly smaller than the internal diameter of the bushing 321 and which has a conical bevel on the face directed towards the extension 1012.

To disassemble a second rolling bearing 320, the axially aligned first rolling bearing 310 is firstly removed from the drum part of the revolver drum 3. The tool 1000, with its blocking slide 1015 to the front, is then inserted through the resulting opening in the drum part 31 into the bushing 321 of the second rolling bearing 320, as is shown in FIG. 13. The ram 1013 is held pressed inwards such that an annular gap forms between the blocking slide 1015 and the extension 1012, in which annular gap at least one locking ball 1016 is located. By letting go of the ram 1013, the helical spring 1014 pushes the blocking slide 1015 outwards (towards the right in the figure). By way of the bevel of the blocking slide 1015, the locking ball 1016 is pressed radially outwards until it latches in the annular groove 329 of the bushing 321. The second rolling bearing 320 can now be pulled out from the second drum part 32 by means of the tool 1000 and can be removed from the ring rolling device through the first drum part 31. To insert a second rolling bearing 320, the reverse procedure is carried out, wherein the tool 1000 can be pulled out from the inserted rolling bearing 320 when the ram 1013 is pressed in.

In the example shown, the tool 1000 has, as the grip element, a ball 1016 or also a plurality of balls. Balls have the advantage of being able to be blocked easily in their end position, without having to be aligned for this purpose.

The above-described design of the advancing arrangement as a revolver drum, in particular with a plurality of mandrels mounted rotatably thereon, is preferred, but the invention is not limited to this. Thus, the advancing arrangement, for example, can also be embodied as a movable mandrel bearing arrangement which, by way of corresponding drive devices, is movable in one or two dimensions, wherein the mandrel is brought to the loading position, moved against the drive roller and brought away from the drive roller to the unloading position.

The invention claimed is:

1. A ring rolling device for enlarging a ring blank, comprising: a press element, an advancing arrangement, a rotatably mounted mandrel comprising a first end part, a second end part and a middle part therebetween, around which the ring blank can be mounted, and the mandrel is rotatably mounted with its first end part in a first rolling bearing and with its second end part in a second rolling bearing, such that the middle part of the mandrel lies free for the mounting of the ring blank, and wherein the mandrel is movable by the advancing arrangement towards the press element and away from the latter again, wherein a roll gap which decreases in size, and in which the ring blank is rolled, is formed between the mandrel and the press element, wherein the second rolling bearing is arranged axially fixed in the advancing arrangement, and the mandrel is mounted so as to be axially movable relative to the second rolling bearing, such that the second end part of the mandrel can be pulled out of the second rolling bearing or pushed into the latter, wherein the first rolling bearing is also arranged axially fixed in the advancing arrangement, and the mandrel is mounted so as to be axially movable relative to the first rolling bearing.

2. The ring rolling device according to claim 1, wherein the first and second rolling bearings are designed as tangentially movable bearings.

3. The ring rolling device according to claim 2, wherein the first and second rolling bearings are designed as spherical roller bearings or self-aligning ball bearings.

4. The ring rolling device according to claim 1, wherein axially fixed sleeve-shaped bushings for receiving the mandrel are mounted rotatably in the first and second rolling bearings.

5. The ring rolling device according to claim 4, wherein the bushings are arranged so as to be tiltable relative to a rotation axis of the first and second rolling bearings.

6. The ring rolling device according to claim 5, wherein the tiltability of the bushings is limited by stops.

7. The ring rolling device according to claim 4, wherein at least the bushing arranged in the second rolling bearing has a funnel-shaped insertion bevel.

8. The ring rolling device according to claim 4, wherein at least the bushing arranged in the second rolling bearing has a form-fit element for the engagement of an assembly tool.

9. The ring rolling device according to claim 8, wherein the form-fit element is designed as an annular groove.

10. The ring rolling device according to claim 1, wherein the mandrel at its front end on the second end part has a conical or rounded shape.

11. The ring rolling device according to claim 1, wherein the advancing arrangement has a stop element for the front end of the mandrel, for positioning the mandrel axially in a longitudinal direction of the mandrel.

12. The ring rolling device according to claim 11, wherein the stop element protrudes partially into the second rolling bearing and is designed with a feed line, for a cleaning agent and/or coolant, emptying into the interior of the second rolling bearing.

13. The ring rolling device according to claim 11, wherein the stop element is mounted rotatably.

14. The ring rolling device according to claim 11, wherein the stop element is adjustable.

15. The ring rolling device according to claim 1, wherein the advancing arrangement has a stop element to engage a stop collar located on the first end part of the mandrel, for positioning the mandrel axially in a longitudinal direction of the mandrel.

16. The ring rolling device according to claim 15, wherein axially fixed sleeve-shaped bushings for receiving the mandrel are mounted rotatably in the first and second rolling bearings and the stop element is formed by the bushing mounted rotatably in the first rolling bearing.

17. The ring rolling device according to claim 1, wherein the advancing arrangement is a rotatable revolver drum, wherein the revolver drum is arranged relative to the press element such that, by rotating the revolver drum, the decreasing roll gap is formed between the mandrel and the press element.

18. The ring rolling device according to claim 17, wherein the revolver drum comprises two drum parts, each in the shape of a disc, which are spaced apart from each other and are rigidly connected to each other for conjoint rotation and in which the first rolling bearing and the second rolling bearing for the mandrel are arranged in an axially fixed manner.

19. The ring rolling device according to claim 1, wherein the first and second rolling bearings are each mounted in the advancing arrangement so as to be exchangeable in their entirety.

20. The ring rolling device according to claim 1, wherein it has a cooling system for the rolling bearings and/or advancing arrangement.

21. The ring rolling device according to claim 20, wherein the cooling system is closed.

* * * * *